United States Patent [19]

Migitaka et al.

[11] 4,127,472

[45] Nov. 28, 1978

[54] PROCESS FOR PREPARING A RAW MATERIAL FOR THE MANUFACTURE OF NEEDLE COKE

[75] Inventors: Wataru Migitaka, Kawasaki; Hirofumi Sunago; Yukiyosi Ogawa, both of Kitakyushu; Takanori Nisihata, Buzen, all of Japan

[73] Assignee: Nittetsu Chemical Industrial Co., Ltd., Japan

[21] Appl. No.: 854,069

[22] Filed: Nov. 22, 1977

[30] Foreign Application Priority Data

Nov. 26, 1976 [JP] Japan ..... 51/141133

[51] Int. Cl.[2] ..... C10G 9/00; C10G 21/06

[52] U.S. Cl. ..... 208/87; 208/45; 208/106; 208/131

[58] Field of Search ..... 208/45, 46, 87, 106, 208/131

[56] References Cited

U.S. PATENT DOCUMENTS

| | | | |
|---|---|---|---|
| 2,871,181 | 1/1959 | Kulik | 208/45 |
| 2,955,079 | 10/1960 | Foley | 208/45 |
| 3,147,205 | 9/1964 | Ohsol et al. | 208/45 |
| 3,617,515 | 11/1971 | Bloomer | 208/131 |
| 3,799,865 | 3/1974 | Suetsugu et al. | 208/131 |

*Primary Examiner*—Herbert Levine

*Attorney, Agent, or Firm*—Wenderoth, Lind & Ponack

[57] ABSTRACT

In mixing coal tar and/or coal tar pitch with aromatic and aliphatic solvents at atmospheric pressure and at a temperature between 15° C and 140° C to prepare a raw material for the manufacture of needle coke, the mixing ratio of the aromatic and aliphatic solvents and their quantities of addition to the coal tar and/or coal tar pitch are adjusted so that insoluble substances precipitate in a pitch zone. A supernatant obtained by separating the insoluble substances is distilled, and hydrocarbons consisting substantially of aromatic compounds and freed of the insoluble substances are obtained. Then the hydrocarbons are used as the raw material for the manufacture of needle coke.

14 Claims, 1 Drawing Figure

PROCESS FOR PREPARING A RAW MATERIAL FOR THE MANUFACTURE OF NEEDLE COKE

BACKGROUND OF THE INVENTION (A) Field of the Invention

For the manufacture of artificial graphite electrodes for use in ultra-high-powered electric furnaces, anisotropic needle coke that can be readily graphitized is in popular use.

The invention relates to a process for preparing such needle coke. More particularly, it relates to a process for preparing a raw material for the manufacture of such needle coke by removing insoluble substances containing quinoline insoluble materials from coal tar and/or coal tar pitch.

(B) Description of the Prior Art

Various proposals have recently been made for the preparation of needle coke from such coal tar and/or coal tar pitch as contain quinoline insoluble materials which have been thought to be unsuitable for the purpose, by removing undesirable insoluble components. For instance, one of such processes comprises heat-treating coal tar pitch at a pressure between 0 and 10 $kg/cm^2$ and at a temperature between 350° C. and 390° C. Then, quinoline insoluble materials is filtered off through a 5 to 10 $\mu m$ filter, at a temperature between the the softening point of the pitch and 350° C. The resulting filtrate is processed into readily graphitizable needle coke. According to another known process, 100 parts of coal tar pitch is diluted with 50 parts of wash oil, by weight respectively. Quinoline insoluble materials contained in the diluted coal tar is filtered off by a vacuum rotary filter at 140° C. Then, the wash oil is separated from the refined pitch by vacuum distillation. The resulting refined pitch is processed into needle or linear-shaped dry-distilled coke. However, these conventional processes involve great difficulties in processing large quantities of materials.

For instance, the separation of insoluble substances from a highly viscous mixture cannot be attained unless a large quantity of such solvent as has a high dissolving power is used. Even then, no great effect is achieved, since quinoline insoluble materials is very fine grains dispersed or suspended in the pitch. Conversely, difficulty is encountered in disposing of the large quantity of used solvent.

Further, there are many problems that prevent efficient separation, such as filter clogging, difficulties in continuing centrifuge operation and in equipment maintenance due to splashing and adhesion of tacky substances. In addition, provision of a centrifuge and other large equipment leads to disadvantageously high cost. For these reasons, the conventionally proposed processes may be practiced on the laboratory scale, but not advantageous on the industrial scale.

OBJECT AND SUMMARY OF THE INVENTION

The object of this invention is to provide a process for removing quinoline insoluble materials from coal tar and/or coal tar pitch, for the purpose of preparing a raw material for the manufacture of needle coke.

To attain this process, the inventors have made various studies. As a consequence, it has now been found that insoluble substances in the mixture precipitate when coal tar and/or coal tar pitch is mixed with aromatic and aliphatic solvents, and that the precipitated insoluble substances contain quinoline insoluble materials and other ingredients that are readily convertible to quinoline insoluble materials by heating, which are undesirable to the preparation of needle coal pitch coke.

The inventors also have found that, when coal tar and/or coal tar pitch is mixed with aromatic and aliphatic solvents, the insoluble substances precipitate in four modes, i.e., in a slurry, crystal, pitch and oily zone, as described later, depending on the mixing ratio among the aforesaid three constituents. It has accordingly been found that the insoluble substances can be precipitated either in the slurry, crystal or pitch zone by controlling the mixing ratio among coal tar and/or coal tar pitch, aromatic and aliphatic solvents.

The insoluble substances occurring in the slurry zone settle by gravity at an average speed of 1/10 to 10 mm per minute, those occurring in the crystal zone at an average speed of 1/100 to 5 mm per minute, and those occurring in the pitch zone at an average speed of not less than 8 mm per minute, all at 40° C.

The insoluble substances precipitating in the crystal zone are plate- or flake-shaped crystalline materials having lengths of several millimeters, those precipitating in the slurry zone are particles ranging between approximately 0.5 and 1 mm in size, and those in the pitch zone assume the form of pitcry. In the oily zone, no insoluble substance precipitates, but oily sediment settles sometimes.

By suitably controlling the types and quantities of coal tar and/or coal tar pitch, aromatic and aliphatic solvents to be mixed, the separation of insoluble substances in the pitch zone can be accomplished not by use of such complex means as pressure filter and centrifuge, but by use of such simple means as gravity settling and liquid cyclone. According to this process, a raw material for the manufacture of needle coke can be obtained very advantageously on the industrial scale.

The process of this invention permits increasing the settling speed of the precipitated insoluble substances, which consequently makes their separation very easy.

Since the insoluble substances precipitating in the pitch zone settle rapidly and are readily removable, their separation process can be operated in the temperature range between 15° C. and 140° C., without requiring any higher temperature. This offers a great industrial merit.

In brief, the features of this invention are as follows:

(A) Coal tar and/or coal tar pitch, aromatic and aliphatic solvents are mixed at atmospheric pressure and at a temperature between 15° C. and 140° C.

(B) The mixing ratios among the coal tar and/or coal tar pitch, aromatic and aliphatic solvents are adjusted so that insoluble substances precipitate in the pitch zone at a temperature between 15° C. and 140° C.

(C) By distilling a supernatant obtained by separating the insoluble substances, hydrocarbons consisting substantially of aromatic compounds and freed of quinoline insoluble materials are obtained. The obtained hydrocarbons are processed into the raw material for the manufacture of needle coke.

DETAILED DESCRIPTION OF THE INVENTION

Figure 1:
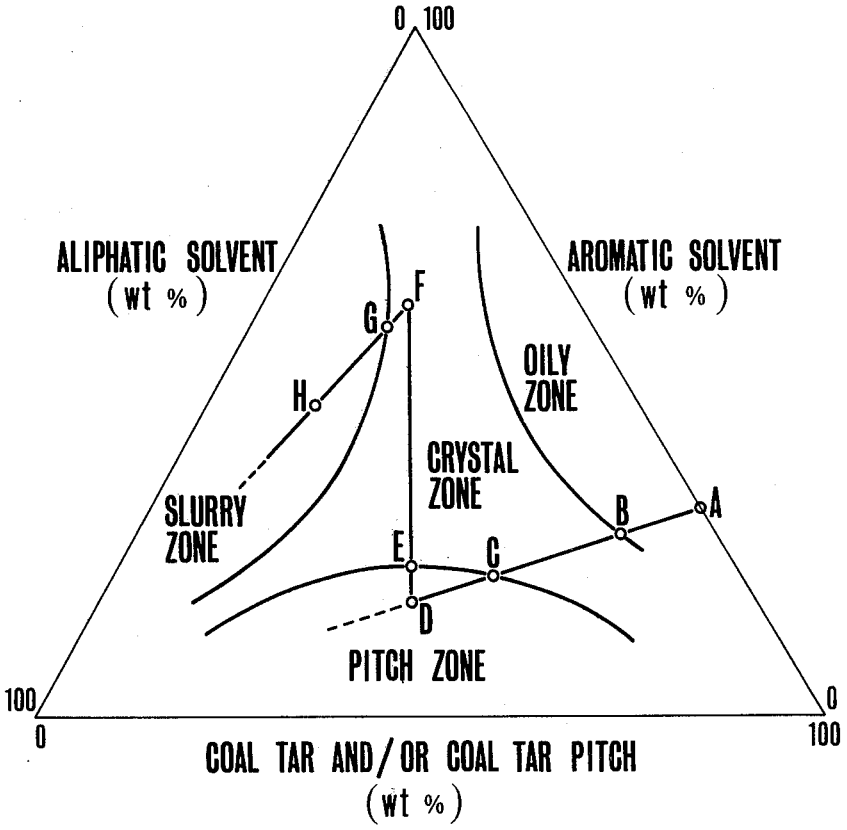

Ordinary coal tar that occurs as a by-product in the carbonization of coal serves the purpose of this invention. Coal tar pitch used in this invention is one that is obtained by cutting down light oils in coar tar by distillation. Cutback tar suitably blended with light oils may also be used. Of these materials, coal tar pitch is more preferable, especially soft coal tar pitch whose softening point (according to the R & B method) ranges between 20° C. and 40° C. and Conradson's carbon residue between 25 and 40 percent by weight.

Aromatic solvents used for this invention consist substantially of aromatic hydrocarbons and have initial boiling points of not lower than 80° C. and accomplish 95 percent by volume distillation at temperatures not higher than 400° C. Those which have initial boiling points of not lower than 140° C. and accomplish 95 percent by volume distillation at temperatures not higher than 300° C. are preferable. Especially, those which have initial boiling points of not lower than 140° C. and accomplish at least 60 percent by volume distillation at temperatures between 200° C. and 230° C. and 95 percent by volume distillation at temperatures not higher than 300° C. are best suited.

Such aromatic solvents include, for instance, benzene, toluene, xylene, creosote oil, wash oil, anthracene oil the delayed coker oil obtained as a by-product in the manufacture of raw coal pitch coke by the delayed coking process, and their mixtures whose distillation characteristics fall within the aforesaid ranges.

Aliphatic solvents used for this invention consist substantially of aliphatic hydrocarbons and have initial boiling points of not lower than 30° C. and accomplish 90 percent by volume distillation at temperatures not higher than 350° C. For instance, n-hexane, petroleum naphtha, petroleum kerosene and gas oil. Preferable aliphatic solvents have initial boiling points of not lower than 150° C. and accomplish 95 percent by volume distillation at temperatures not higher than 320° C. Those which have initial boiling points of not lower than 150° C. and accomplish 95 percent by volume distillation at temperatures not higher than 250° C., such as industrial gasoline, petroleum naphtha and petroleum kerosene falling within the aforesaid boiling point ranges, are more preferable.

The process of this invention comprises the steps of mixing said aromatic and aliphatic solvents with coal tar and/or coal tar pitch at a temperature between 15° C. and 140° C., separating insoluble substances to be described later, distilling a supernatant obtained by removing the insoluble substances.

In mixing coal tar and/or coal tar pitch and the two solvents, coal tar and/or coal tar pitch may be added first with the aromatic solvent at a temperature between 15° C. and 140° C., preferably between 70° C. and 140° C., then with the aliphatic solvent. Or, the two solvents may be added to coal tar and/or coal tar pitch at a time. In either case, generally, eventual precipitation of insoluble substances is not different. In adding the solvents, a predetermined temperature must be maintained. There is not need for pressuirization, they may be added at atmospheric pressure. The mixing of coal tar and/or coal tar pitch with the solvents requires no special method, so far as a uniform mixture is obtained. The mixing time usually ranges between about 0.5 minute to 5 hours, though it varies with the stirring efficiency and other factors. When cutback tar is used as the material, the quantities of the solvents may be suitably adjusted since it contains more aromatic oil than ordinary tar does.

To insure uniform mixing and good precipitation of the insoluble substances, coal tar and/or coal tar pitch is mixed with the solvents at a temperature between 15° C. and 140° C., and preferably between 70° C. and 140° C. It is possible to mix at higher temperatures, but no particular benefit results. Conversely, high-temperature mixing generates much oil vapor.

FIG. 1 is a composition diagram showing the precipitation of the insoluble substances resulting from the mixing of coal tar and/or coal tar pitch with the solvents. The quantities of coal tar and/or coal tar pitch and the solvents affect the precipitation of the insoluble substances from their mixture. FIG. 1 illustrates the relationship between the mixing ratio and the precipitation of the insoluble substances. Reference characters used in the following description correspond to respective compositional points in FIG. 1.

Coal tar and/or coal tar pitch and an aromatic solvent are mixed at a given temperature (point A). As an aliphatic solvent is slowly added to the mixture, plate- or flake-shaped crystalline insoluble substances start to precipitate at point B. On further adding the aliphatic solvent, the precipitated insoluble substances become viscous at point C. The, black pitch-like substances settle at the vessel bottom at point D. Beyond point D, the condition of the insoluble substances remain unchanged even if the addition of the aliphatic solvent is continued. On adding the aromatic solvent to the compositional matter at point D, viscous plate-shaped crystalline insoluble substances start to precipitate again at point E. On further adding the aromatic solvent, they change to non-viscous plate-shaped crystalline insoluble substances (point F). On changing the solvent to aliphatic, the insoluble substances begin to beome granular at point G, and are totally granulated at point H and thereafter.

By changing the solvents added, the insoluble substances precipitate in different conditions as described above. The region between points A and B is defined as the oily zone, because oily substances sometimes settle. The region between points B and C as the crystal zone, because plate-shaped crystalline substances precipitate. The region containing point D as the pitch zone, since black pitch-like substances appear therein. As mentioned before, the region from point E through F to G becomes the crystal zone again. The region containing point H is called the slurry zone, since slurry insoluble substances precipitate in this area.

The boundaries between these zones can be determined clearly by carefully observing the condition of the insoluble substances. The plate-shaped crystalline insoluble substances precipitating in the crystal zone reach several millimeters in length. The particles occurring in the slurry zone range between approximately 0.5 and 1 mm in diameter. The precipitates in the pitch zone are viscous, black, pitch-like substances collectively settling at the vessel bottom. Their softening points are usually higher than those of coal tar and/or coal tar pitch (by the R & B method).

The ranges of the individual zones, in which the insoluble substances precipitate in varied forms according to the mixing ratios between coal tar and/or coal tar pitch and the two solvents, change with the combination of the solvents, as exemplified in Table 1.

Table 1.

Changes in Precipitating Insoluble Substances with Solvents Mixing Combinations and Ratios (Per Cent by Weight) (Example 1)

| Compositional Point | Coal Tar | Toluene | n-hexane |
|---|---|---|---|
| A | 50 | 50 | 0 |
| B | 44 | 44 | 12 |
| C | 36 | 36 | 28 |

Table 1.-continued

| | | | |
|---|---|---|---|
| D | 32 | 32 | 36 |
| E | 28 | 40 | 32 |
| F | 9 | 81 | 10 |
| G | 8 | 77 | 15 |
| H | 7 | 67 | 26 |

Note. Compositional points A, B, C, .... H correspond to the compositional points A, B, C, .... H in the explanatory description of Fig. 1.

(Example 2)

| Compositional Point | Soft Coal Tar Pitch | Wash Oil | Industrial Gasoline No. 4 |
|---|---|---|---|
| A | 60 | 40 | 0 |
| B | 43 | 29 | 28 |
| C | 41 | 27 | 32 |
| D | 25 | 16 | 59 |
| E | 23 | 25 | 52 |
| F | 14 | 54 | 32 |
| G | 11 | 42 | 47 |
| H | 8 | 60 | 32 |

Note 1. Compositional points A, B, C, .... H correspond to the compositional points A, B, C, .... H in the explanatory description of Fig. 1.

Note 2. Wash oil (obtained by coal tar distillation)

| | |
|---|---|
| Initial boiling point | 191° C |
| 60 % by volume distillation | 220 ° C |
| 95 % by volume distillation | 290° C |

When such aromatic and aliphatic solvents as benzene and n-hexane, respectively, are combined, the crystal zone in FIG. 1 narrows toward the center, while the slurry and pitch zones expand.

Table 2.

| Examples of Solvent Combinations | |
|---|---|
| Aromatic Solvent | Aliphatic Solvent |
| Naphthalene oil | n-hexane |
| Naphthalene oil | Industrial gasoline |
| Naphthalene oil | Kerosene |
| Anthracene oil | n-hexane |
| Anthracene oil | Industrial gasoline |
| Anthracene oil | Kerosene |
| Wash oil | n-hexane |
| Wash oil | Industrial gasoline |
| Wash oil | Kerosene |

The insoluble substances can be precipitated variedly by adding to coal tar and/or coal tar pitch the aromatic and aliphatic solvents combined as shown in Table 2, and adjusting their mixing ratios as exemplified in Table 1.

By thus selecting the combinations and ratios of the solvents in conjunction with the ratio of coal tar and/or coal tar pitch, precipitation in the slurry, crystal or pitch zone can be attained.

But it has been known that if only aromatic solvents, such as toluene, wash oil and anthracene oil, are mixed with coal tar and/or coal tar pitch, the resulting insoluble substances will become very small in particle size and, therefore, difficult to separate. When such aliphatic solvents as n-hexane, kerosene and industrial gasoline are mixed with coal tar and/or coal tar pitch, insoluble substances precipitate and can be separated readily. But only lower molecular weight ingredients of coal tar and/or coal tar pitch pass into the supernatant. Accordingly, hydrocarbons consisting mainly of aromatic compounds, obtained by distilling the supernatant, contain only a small quantity of coal tar and/or coal tar pitch ingredients, and those which are contained are largely of low molecular weight. As a consequence, a low coke yield results and the product coke sometimes lacks a well-developed flow structure. For this reason, the use of only aliphatic solvents does not afford a commercially beneficial coke yield.

In contrast, it is the prerequisite of this invention to use both aromatic and aliphatic solvents. Their combined mixture with coal tar and/or coal tar pitch permits easy separation of insoluble substances and increases the yield of high-quality coke with a well-developed flow structure.

The insoluble substances in these zones generally are large-sized. In the slurry zone, they settle at an average speed ranging between 1/10 and 10 mm per minute (at 40° C.). In the crystal zone, they settle at an average speed between 1/100 and 5 mm per minute, and at an average speed of not lower than 8 mm per minute in the pitch zone. The precipitates in the pitch zone, which are the object product of this invention, are viscous, black, pitch-like substances settling collectively at the vessel bottom, and can be separated very easily. The precipitated insoluble substances can be separated by means of gravity settling, liquid cyclone, centrifugal separation and their combinations. The separating process requires no high temperature. It can be effected in such low-temperature ranges as 15° C. to 140° C., and preferably between 20° C. and 100° C. Conventionally, quinoline insoluble materials suspended in coal tar and/or coal tar pitch, usually smaller than 10 μm in diameter, have not been removed efficiently on the industrial scale by any of the aforesaid separating methods.

In the process of this invention, the precipitated insoluble substances are not composed of insoluble quinoline only, but of high-molecular matters containing quinoline insoluble materials. These insoluble substances settle rapidly and are easy to separate.

This invention offers a great industrial advantage by separating the insoluble substances in the pitch zone. The separated insoluble substances are black, pitch-like materials. In separation, some excess solvents may mix with the insoluble substances, but they may be removed by the conventional method, if required.

A feature of this invention lies in that it has succeeded in increasing the settling speed of the precipitating insoluble substances, which has greatly facilitated their separation. Another feature of this invention is that the temperature in the separating zone is held low. Conventional processes required heating, or pressurization sometimes, to lower the viscosity of the mixture. According to this invention, in contrast, the separating process does not require higher temperature than 140° C., because of the increased settling speed of the insoluble substances and the low viscosity of the mixture.

It is preferable that the used solvents are separated, independently or in combination, from the supernatant after the separating process, by atmospheric or vacuum distillation. The solvents thus distilled away may be reused. In this distillation process, some of light ingredients contained in the material coal tar and/or coal tar pitch are distilled away with the solvents. To simplify this process, it is preferable to limit the temperatures at which the aromatic and aliphatic solvents accomplish 95 percent by volume distillation to not higher than 300° C. and 250° C., respectively.

This distillation process may be omitted. The supernatant resulting from the insoluble substance separating process may then be used as the material for the delayed-coking process. The solvents may be recovered in the distilling tower always employed in the delayed-coking process.

Raw coke is obtained from the coal tar and/or coal tar pitch thus refined by the ordinary coking process, and preferably by the delayed-coking process. By calcining the obtained raw coke, readily graphitizable needle coke is prepared. To facilitate the understanding of this invention, the following examples are given, but they should not be considered as limiting the scope of this invention.

EXAMPLE 1

One part weight of coal tar containing 6.7 percent by weight toluene insoluble materials and 1.9 percent by weight quinoline insoluble materials was mixed with ½ part by weight of toluene and 1 part by weight of n-hexane. The mixture was stirred at 80° C. and allowed to cool to 40° C. Insoluble substances precipitated very rapidly and settled collectively, assuming the form of black pitch, at the vessel bottom. After standing and separating the insoluble substances, the supernatant was distilled under a reduced pressure of 100 torr. The material thus obtained had the softening point of 23° C. (by the R & B method) and contained 2.6 percent by weight toluene insoluble materials and traces of quinoline insoluble materials. By coking the prepared material in an autoclave at 2.5 kg/cm$^2$, raw coke with a well-developed flow structure was obtained in a yield of 34 percent by weight against the material coal tar. The raw coke was calcined, and graphitized at 2800° C. The product exhibited a coefficient of thermal expansion of $0.8 \times 10^{-6}$/degree and Co of 6.716 Å.

Note. Co = mean unit cell length measured by X-ray diffraction

EXAMPLE 2

One part by weight of soft coal tar pitch having a softening point of 23° C. (by the R & B method) and containing 7.9 percent by weight toluene insoluble materials and 2.2 percent by weight quinoline insoluble materials was mixed and stirred with 1/6 part by weight of wash oil at 70° C., then with ½ part by weight of industrial gasoline No. 4 (JIS K 2201). The mixture was allowed to cool to 40° C. Black, pitchlike insoluble substances precipitated at a rate of 33 mm per minute. The insoluble substances were separated by gravity settling. The resulting supernatant was distilled under a reduced pressure of 100 Torr. The material thus obtained had a softening point of 27° C. (by the R & B method) and contained 5.2 percent weight toluene insoluble materials and traces of quinoline insoluble materials. By coking under the same conditions as employed for Example 1, raw coke with a well-developed flow structure was obtained in a yield of 51 percent by weight against the material soft coal tar pitch. The product, obtained after graphitization at 2800° C., exhibited a coefficient of thermal expansion of $0.9 \times 10^{-6}$/degree and Co of 6.720 Å.

Note. Co = mean unit cell length measured by X-ray diffraction

COMPARATIVE EXAMPLE

Raw coke was prepared by coking the same soft coal tar pitch as used in Example 2, under the same conditions except the solvent-processing according to this invention. The yield against the raw material used was 56 percent by weight, but no flow structure was observed. The product graphitized at 2800° C. exhibited a coefficient of thermal expansion of $1.9 \times 10^{-6}$/degree and Co of 6.738 Å.

Note. Co = mean unit cell length measured by X-ray diffraction

What is claimed is:

1. A process for preparing a raw material for the manufacture of needle coke comprising the steps of mixing coal tar and/or coal tar pitch with aromatic and aliphatic solvents at atmospheric pressure and at a temperature between 15° C. and 140° C., with the mixing ratio of the aromatic and aliphatic solvents and their quantities of addition to the coal tar and/or coal tar pitch being adjusted so that insoluble substances precipitate in a pitch zone, distilling a supernatant obtained by separating the insoluble substances, obtaining hydrocarbons consisting substantially of aromatic compounds and freed of the insoluble substances, and using the hydrocarbons as the raw material for the manufacture of needle coke.

2. A process according to claim 1, wherein the coal tar pitch used is soft coal tar pitch.

3. A process according to claim 1, wherein the aromatic solvent is at least one member selected from the group consisting of creosote oil, wash oil, and anthracene oil.

4. A process according to claim 1, wherein the aromatic solvent is delayed coker by-product oil obtained when preparing raw coal pitch coke.

5. A process according to claim 1, wherein the aromatic solvent has an initial boiling point of not lower than 80° C. and accomplishes 95 percent by volume distillation at a temperature not higher than 400° C.

6. A process according to claim 1, wherein the aromatic solvent preferably has an initial boiling point of not lower than 140° C. and accomplishes 95 percent by volume distillation at a temperature not higher than 350° C.

7. A process according to claim 1, wherein the aromatic solvent more preferably has an initial boiling point of not lower than 140° C. and accomplishes at least 60 percent by volume distillation at a temperature between 200° C. and 230° C. and 95 percent by volume distillation at a temperature not higher than 300° C.

8. A process according to claim 1, wherein the aliphatic solvent is at least one member selected from the group consisting of industrial gasoline, naphtha and kerosene.

9. A process according to claim 1, wherein the aliphatic solvent has an initial boiling point of not lower than 30° C. and accomplishes 90 percent by volume distillation at a temperature not higher than 350° C.

10. A process according to claim 1, wherein the aliphatic solvent preferably has an initial boiling point of not lower than 150° C. and accomplishes 95 percent by volume distillation at a temperature not higher than 320° C.

11. A process according to claim 1, wherein the aliphatic solvent more preferably has an initial boiling point of not lower than 150° C. and accomplishes 95 percent by volume distillation at a temperature not higher than 250° C.

12. A process according to claim 1, wherein the mixing is effected in the temperature range between 70° C. and 140° C.

13. A process according to claim 1, wherein the separation is effected in the temperature range between 20° C. and 100° C.

14. A process according to claim 1, wherein the separation is accomplished by the gravity settling method or the liquid cyclone method.

* * * * *